US007677717B2

(12) United States Patent
Islam et al.

(10) Patent No.: US 7,677,717 B2
(45) Date of Patent: Mar. 16, 2010

(54) DRUM MAINTENANCE SYSTEM FOR AN IMAGING DEVICE AND METHOD AND SYSTEM FOR MAINTAINING AN IMAGING DEVICE

(75) Inventors: Abu S. Islam, Rochester, NY (US); Michael C. Gordon, West Linn, OR (US); Joseph B. Gault, Portland, OR (US); Alexander J. Fioravanti, Penfield, NY (US); Kelly Anne Kessler, Wilsonville, OR (US); Larry Eugene Hindman, Woodburn, OR (US); Bruce Karl Baur, Milwaukie, OR (US); Ernest I. Esplin, Sheridan, OR (US); Scott J. Phillips, W. Henrietta, NY (US); Roger G. Leighton, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 938 days.

(21) Appl. No.: 11/315,178

(22) Filed: Dec. 23, 2005

(65) Prior Publication Data

US 2007/0146461 A1 Jun. 28, 2007

(51) Int. Cl.
*B41J 2/01* (2006.01)
*B41J 2/015* (2006.01)
*B41J 2/165* (2006.01)

(52) U.S. Cl. ..... 347/103; 347/21; 347/33

(58) Field of Classification Search ..... 347/103, 347/22, 21, 28, 36, 29, 30, 31, 32, 33

See application file for complete search history.

(56) References Cited

U.S. PATENT DOCUMENTS

| | | | | |
|---|---|---|---|---|
| 4,309,957 | A | | 1/1982 | Swift |
| 4,415,886 | A | * | 11/1983 | Kyogoku et al. ..... 340/618 |
| 5,200,786 | A | | 4/1993 | Fromm et al. |
| 5,365,261 | A | * | 11/1994 | Ozawa et al. ..... 347/103 |
| 5,502,476 | A | * | 3/1996 | Neal et al. ..... 347/103 |
| 5,805,191 | A | | 9/1998 | Jones et al. |
| 5,856,834 | A | * | 1/1999 | Murphy, III ..... 347/23 |
| 5,937,225 | A | * | 8/1999 | Samuels ..... 399/27 |
| 5,970,273 | A | * | 10/1999 | Zenk et al. ..... 399/12 |
| 6,029,036 | A | * | 2/2000 | Itaya et al. ..... 399/239 |
| 6,062,669 | A | * | 5/2000 | Lee ..... 347/19 |

(Continued)

OTHER PUBLICATIONS

U.S. Appl. No. 11/315,066, filed Dec. 23, 2005.

(Continued)

*Primary Examiner*—Stephen D Meier
*Assistant Examiner*—Leonard S Liang
(74) *Attorney, Agent, or Firm*—Oliff & Berridge, PLC

(57) ABSTRACT

A maintenance system and method for maintaining an imaging member of an imaging device includes a pre-cleaning device to clean the imaging member; an applicator to apply release agent to the imaging member; a metering device to meter release agent on the imaging member; a reservoir to remotely store release agent; and a pump to supply the applicator with release agent from the reservoir. The saturation level of the applicator is monitored and maintained within a predetermined range. The applicator, pre-cleaning device and metering device may be independently actuated to engage the imaging member. Release agent collected by the pre-cleaning device and/or metering device may be recycled. Debris collected by the pre-cleaning device and/or metering device may be stored and/or removed.

11 Claims, 15 Drawing Sheets

U.S. PATENT DOCUMENTS

| | | | | |
|---|---|---|---|---|
| 6,068,372 | A | 5/2000 | Rousseau et al. | |
| 6,088,560 | A * | 7/2000 | Zenk et al. | 399/237 |
| 6,494,553 | B1 * | 12/2002 | Donahue et al. | 347/7 |
| 6,494,570 | B1 * | 12/2002 | Snyder | 347/103 |
| 6,543,875 | B2 * | 4/2003 | Gomez et al. | 347/23 |
| 6,687,467 | B2 * | 2/2004 | Katoh | 399/30 |
| 6,967,733 | B1 * | 11/2005 | Minowa | 358/1.15 |
| 7,036,905 | B2 * | 5/2006 | Nagai et al. | 347/22 |
| 7,036,920 | B2 * | 5/2006 | Rousseau et al. | 347/103 |
| 7,048,369 | B2 * | 5/2006 | Rousseau et al. | 347/103 |
| 7,128,412 | B2 | 10/2006 | King et al. | |
| 7,211,151 | B2 * | 5/2007 | Takekoshi et al. | 118/603 |
| 7,254,563 | B1 * | 8/2007 | Gelfer | 705/401 |
| 2002/0167556 | A1 * | 11/2002 | Suenaga et al. | 347/7 |
| 2003/0156170 | A1 * | 8/2003 | Sesek et al. | 347/86 |
| 2004/0135860 | A1 | 7/2004 | Williams | |
| 2005/0110855 | A1 | 5/2005 | Taniuchi et al. | |
| 2006/0152566 | A1 * | 7/2006 | Taniuchi et al. | 347/103 |

OTHER PUBLICATIONS

U.S. Appl. No. 11/315,175, filed Dec. 23, 2005.

* cited by examiner

DRUM MAINTENANCE SYSTEM FOR AN IMAGING DEVICE AND METHOD AND SYSTEM FOR MAINTAINING AN IMAGING DEVICE

BACKGROUND

The exemplary embodiments are directed to a maintenance system for an imaging device, and a system and a method of maintaining the imaging device.

In an imaging device, such as, for example, an inkjet printing system, intermediate transfer surfaces are used. The intermediate transfer surface is typically employed with a printhead. Nozzles in the printhead eject an ink image onto the intermediate transfer drum. A final receiving surface is brought into contact with the intermediate transfer drum after the image has been placed thereon by the nozzles in the printhead. The image is then transferred to the final receiving surface. A release agent medium is brought into contact with the intermediate transfer drum to prepare the surface of the drum prior to the next image being formed thereon.

A drum maintenance unit of the related art is used as described in U.S. Pat. No. 5,805,191, which is incorporated herein by reference, to deliver a release agent onto an intermediate transfer surface of an inkjet printer. The release agent assists in providing an acceptable release of an ink image upon transfer of the image from the intermediate transfer surface to the final receiving surface. Each image transfer consumes a certain amount of release agent so that the drum maintenance unit has to be replaced periodically when the release agent is fully consumed. Further, pixels and debris may collect on the intermediate transfer surface, diminishing print quality and requiring maintenance or earlier replacement of the drum maintenance unit. Still further, the structure of the drum maintenance unit of the related art may result in limiting the speed in which a printer may operate.

SUMMARY

Therefore, it would be advantageous to provide a drum maintenance unit with an extended life expectancy that maintains, enhances or improves the quality of prints and the speed of printing. To address or accomplish the above-described advantages, advantages described below, and/or other advantages, a drum maintenance unit of the exemplary embodiments may include a pre-cleaning blade, a metering blade, a release agent reservoir, and an applicator that may be independent from the release agent reservoir. As described in more detail below, the applicator, metering blade and/or pre-cleaning blade may independently engage the intermediate transfer surface of an imaging device to accommodate increased printer speed and/or other advantages.

The exemplary embodiments are described herein with respect to inkjet printers. However, it is envisioned that any imaging device that may incorporate the features of the drum maintenance unit described herein are encompassed by the scope and spirit of the exemplary embodiments.

DETAILED DESCRIPTION OF EMBODIMENTS

Figure 1:
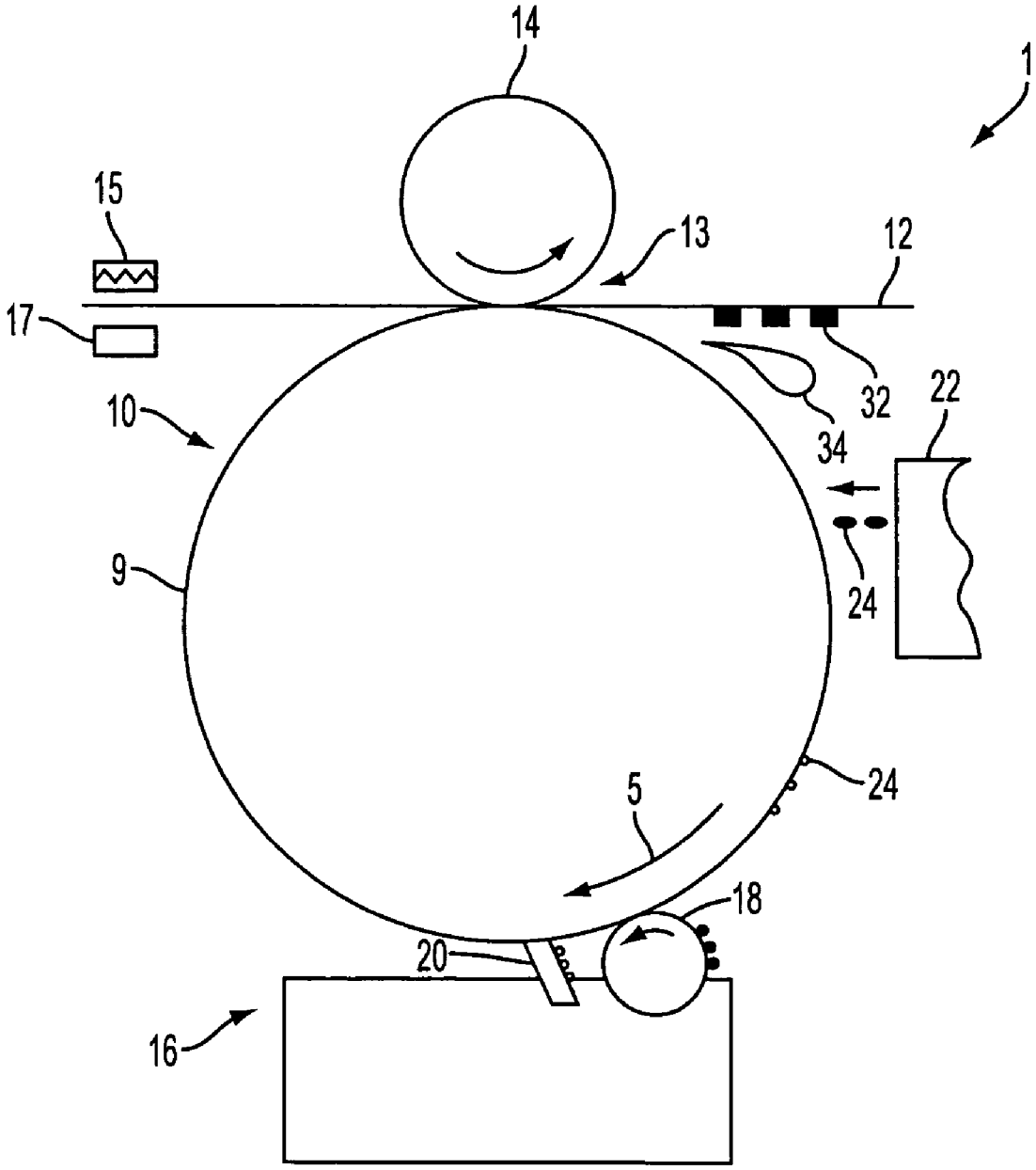
FIG. 1 RELATED ART
FIG. 1 is a schematic of an ink printer in the related art.

An example of a related art imaging process is set forth with reference to FIG. 1. Referring to FIG. 1, a related printing apparatus 1 is illustrated to show transfer of an ink image from an imaging member (shown as a drum 10 in FIG. 1) to a final printing medium or receiving substrate, e.g., print media 12, such as paper, transparency, or the like.

As discussed in more detail below, a release agent is applied to the drum 10 to facilitate the transfer of the ink image to the print media 12. That is, as the drum 10 turns in the direction of arrow 5, the release agent is deposited onto a surface 9 of the drum 10 by a drum maintenance unit (DMU) 16. The DMU 16 has a roller 18 acting as an applicator for applying the release agent to the surface 9 of the drum 10. The DMU 16 also has a blade 20 for metering the release agent to a thin film on the drum 10.

After the roller 18 applies the release agent to the surface 9 of the drum 10 and the metering blade 20 meters off excess release agent, and the excess release agent is reclaimed back into the roller 18. The roller 18 is made of foam or felt and is sized so that the roller 18 can hold a certain amount of release agent. For the roller 18 to continuously apply release agent to the drum 10, the roller 18 may need to reabsorb the excess release agent at a rate greater than or equal to the rate of the release agent being applied to the drum 10.

After the drum 10 is coated with the release agent, an inkjet head 22 ejects an ink image 24 onto the surface of the drum 10. The ink image 24 is applied to the drum 10, and then the ink image 24 is transferred to the print media 12. Some of the release agent may be transferred to the print media 12 along with the ink image 24.

More specifically, the ink image is transferred to the print media 12 at a nip 13 formed between the drum 10 and a transfix roller 14. Feed guides 15 and 17 help to feed the print media 12 into the nip 13 formed between the transfix roller 14 and the drum 10. The feed guide 15 heats the print media 12 prior to the print media 12 entering the nip 13. When the print media 12 is passed between the drum 10 and the transfix roller 14, the ink image 24, now in a malleable state, is transferred from the drum 10 onto the print media 12. The ink image 24 is transferred onto the print media 12 to form an image on the print media 12. The final ink image 32 is spread, flattened, adhered, and fused or fixed to the final print media 12, as the print media 12 moves through the nip 13. Stripper fingers 34 may be used to assist in removing the print media 12, having the final ink image 32 formed thereon, to a final receiving tray (not shown).

The above-described related printing apparatus 1 requires the roller 18 to function as a reservoir and an applicator. As the roller 18 is continuously used, its saturation level decreases with each print, which causes the roller 18 to provide less release agent per print. Accordingly, a print image quality of the final print media may decrease. That is, the roller 18 provides less release agent per print as its saturation level decreases, and the roller 18 begins to run dry causing print quality problems. The entire maintenance system, also called the Drum Maintenance System or DMU 16 is typically replaced when the roller 18 is about, for example, 40% saturated (after about every 30,000 prints), even though other mechanical parts that make up the DMU 16 may not need to be replaced. In related art imaging devices, the DMU 16 is typically replaced four or five times during the life of the imaging device.

As described-above, as the roller 18 applies an excessive amount of release agent to the drum 10, the metering blade 20 reduces the mass of release agent to a thin film. The excess release agent on the drum 10 includes pixels that were not transferred from the last print and debris and are scraped off the drum 10 by the metering blade 20. The pixels and debris flow down the metering blade 20 (aided by gravity) to be filtered out of the excess release agent prior to being reabsorbed by the roller 18. Related art reclaim and filter systems, such as, for example, a wick material to filter pixels and debris and reclaim excess release agent, are not able to reclaim all of the pixels and debris prior to the pixels and debris being reabsorb by the roller 18, when for example, the printer is operated at a sustained high print speed. Over time, the pixels and debris can plug the reclaim and filter system. Thus, over time, excess release agent may build up at the reclaim and filter system, spilling over into other areas of the printing apparatus, and the roller 18 may begin to run dry, severely affecting print quality.

Further, in many cases, the metering blade 20 is not capable of efficiently removing the pixels and debris from the drum 10. For example, when an image requires a higher number of individual pixels, or when the print media 12 is a rough paper, or the like, a number of pixels and debris may not be collected off of the drum 10 by the metering blade 20. Thus, the metering blade 20 of the related art may not be sufficient to efficiently keep the drum 10 clean.

Furthermore, because the roller 18 is in contact with the drum 10 before the metering blade 20 removes the pixels and debris, some of the pixels and debris will transfer directly from the drum 10 to the roller 18. These pixels and debris may plug the porous surface of the roller 18, resulting in a lower rate of delivery of the release agent.

In the above-described related printing apparatus 1, the roller 18 and the metering blade 20 are actuated by a single cam (not shown). That is, the DMU 16 engages the roller 18 and the metering blade 20 in the same motion. Thus, the roller 18 and the metering blade 20 are activated together. Given the inertia of the roller 18 and the speed in which the metering blade 20 will be required to engage and disengage the drum 10, it is unlikely that the actuation of both components, the roller 18 and the metering blade 20, can continue to be performed in the same motion. That is, there is a demand for printers that can print at higher speeds, necessitating much faster and stricter timing requirements on the engagement and disengagement of the applicator and/or metering blade with the drum of the imaging device. Accordingly, the single actuation of both the applicator and metering blade reduces process flexibility, and may not be sufficient for use with some current printers, future printers, and/or other imaging devices.

The above-identified problems and other issues are addressed or resolved by the exemplary embodiments. In particular, the exemplary embodiments provide apparatus, systems and methods to clean an ink print drum; replenish the release agent applicator in the ink drum maintenance system; maintain the applicator saturation level; manage and store non transferred ink and debris and ink on drum (IOD) marks; and apply release agent to the drum and meter a thin, uniform film of the release agent on the drum of the ink printer. The exemplary embodiments increase DMU life, enhance or improve print quality performance over life, increase the printing duty cycle, reduce costs, and/or reduce the rate of human intervention.

Although the exemplary embodiments are described herein with respect to an ink printer, it is envisioned that the exemplary embodiments may be used with any imaging device or non-imaging device that requires the application and metering of an agent onto a surface and the cleaning of excess agent and/or debris from the surface. For example, the exemplary embodiments may encompass printers, copiers, facsimile machines, and the like, and/or may encompass machinery used in factories for the manufacturing of products, recreational vehicles including bicycles, motor vehicles including automobiles, refrigeration devices, or the like.

I. Drum Maintenance Unit or System (DMU)

More specifically, the exemplary embodiments may include a drum maintenance unit or system (DMU) having a reservoir; an applicator that may be independent from the reservoir; a metering blade; a blade that pre-cleans the drum of un-transferred pixels and debris; a single cam or dual cam that provides independent actuation of a metering blade, the applicator and/or the pre-cleaning blade; a pixel and debris collection and storage container; and a pixel and debris filter. Further, the DMU may provide a variable engagement position of the applicator, wherein a timing of the applicator, metering blade, and pre-cleaning blade are optimized for high-speed high-quality print images.

Referring to FIGS. 2-8, a printing apparatus 100 is shown with an imaging member 102 and a drum maintenance unit (DMU) 106. The DMU 106 includes an applicator 108, a metering blade 110, a pre-cleaning blade 112, and a filter 168 and debris storage system 114. As shown in the embodiments of FIGS. 2-8, various exemplary applicators 108 may be used with the same reservoir and/or pump delivery system discussed more fully below. It should be understood that the applicator 108 may be any device that can apply an agent to the imaging member 102, and the imaging member 102 may be any device on which an image may be transferred to or from, such as, for example, a belt member, a film member, a sheet member, or the like.

II. Applicators

Figure 2:
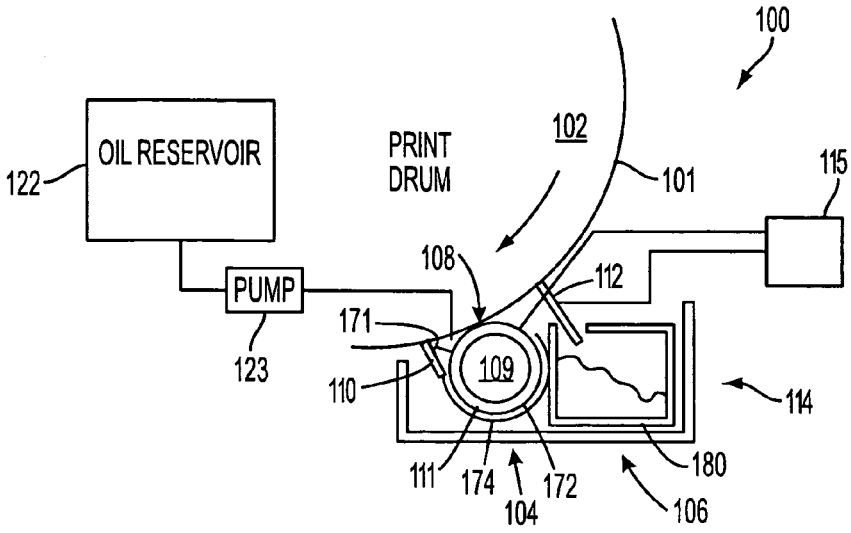
FIG. 2 is a schematic of an ink printer with a roller type applicator in an exemplary embodiment.
Figure 8:
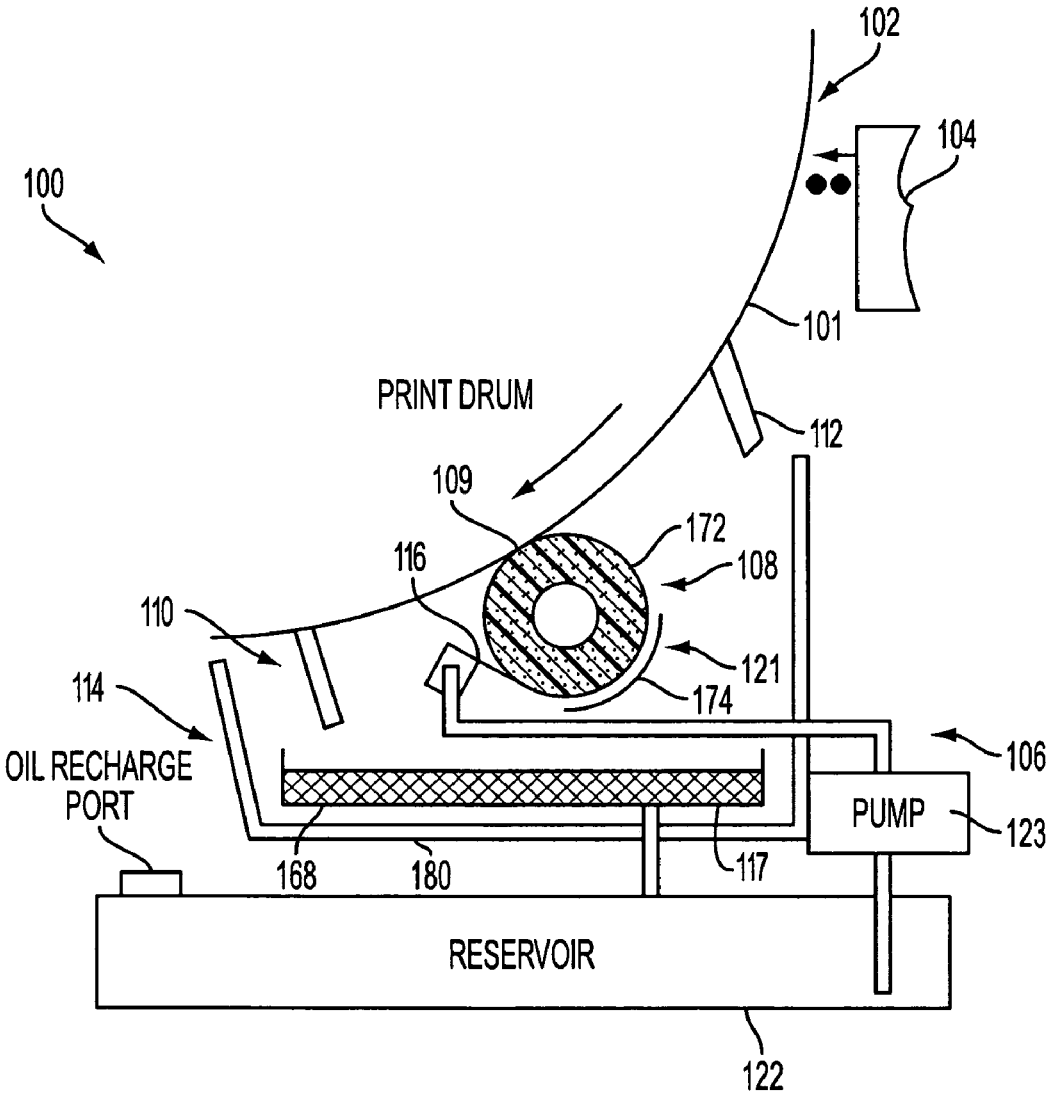
FIG. 8 is a schematic of an ink printer with a roller type applicator in an exemplary embodiment.

Referring to FIGS. 2 and 8, the applicator 108 is shown as a roller and the imaging member 102 is shown as a drum. The applicator 108 (hereinafter "roller 9") may be loaded with a release agent that is applied to the imaging member 102 (hereinafter "drum 102") when the roller 109 is moved into contact with a surface 101 of the drum 102. A thin layer 111 of release agent on the roller 9 is shown in FIG. 2. A factor in the amount of release agent applied to the drum 102 is dependent on the penetration of the roller 109 into the surface 101 of the drum 102, and the amount of release agent left in the roller 109. The rate of migration through the roller 109 is another factor in determining the amount of release agent applied to the surface 101 of the drum 102.

Figure 3:
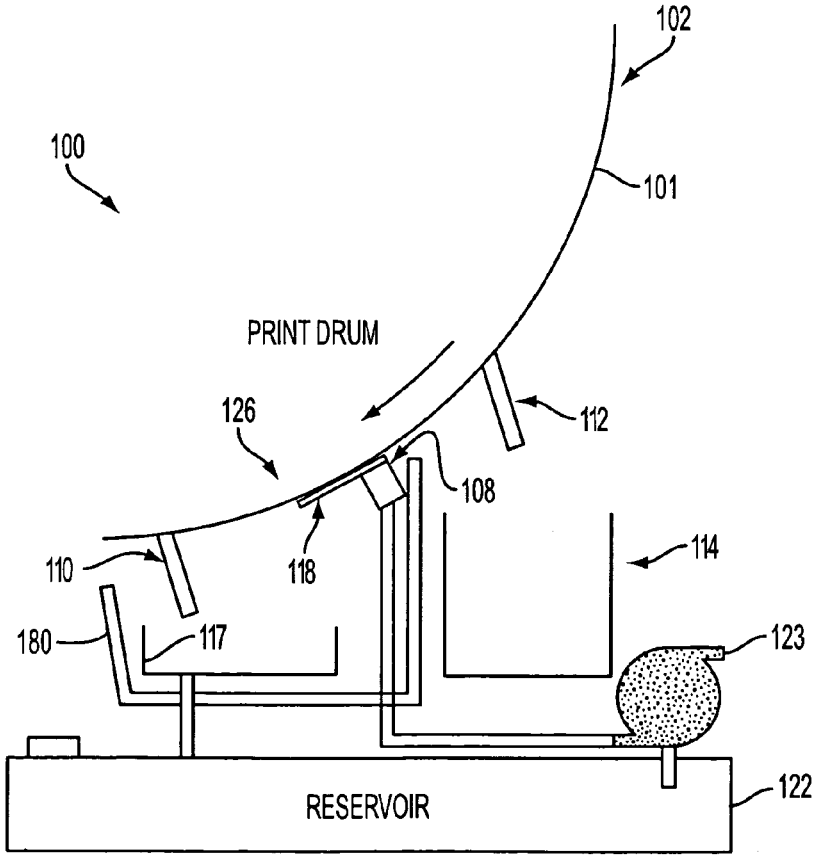
FIG. 3 is a schematic of an ink printer with a sled type applicator in an exemplary embodiment.
Figure 4:
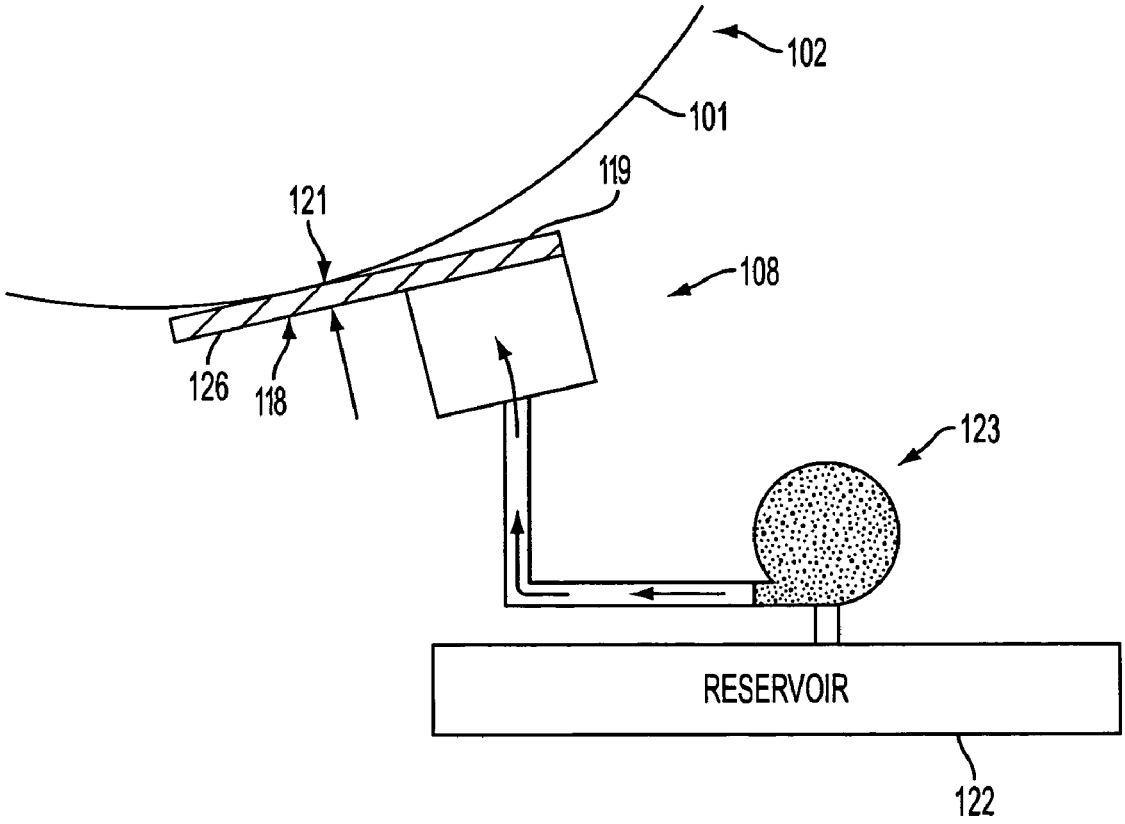
FIG. 4 is a schematic of the sled type applicator of FIG. 3.

Referring to FIGS. 3 and 4, the applicator 108 may be a sled 118. In the embodiment of FIGS. 3 and 4, release agent is supplied directly to the sled 118 that is in contact with the drum 102. The release agent may be flooded into a region 121 between the surface 101 of the drum 102 and a top surface 126 of the sled 118. The sled 118 may have a thin layer of reservoir material, i.e., a reservoir pad 119, to help balance any non-uniformity issues due to, for example, machine tilt.

Figure 5:
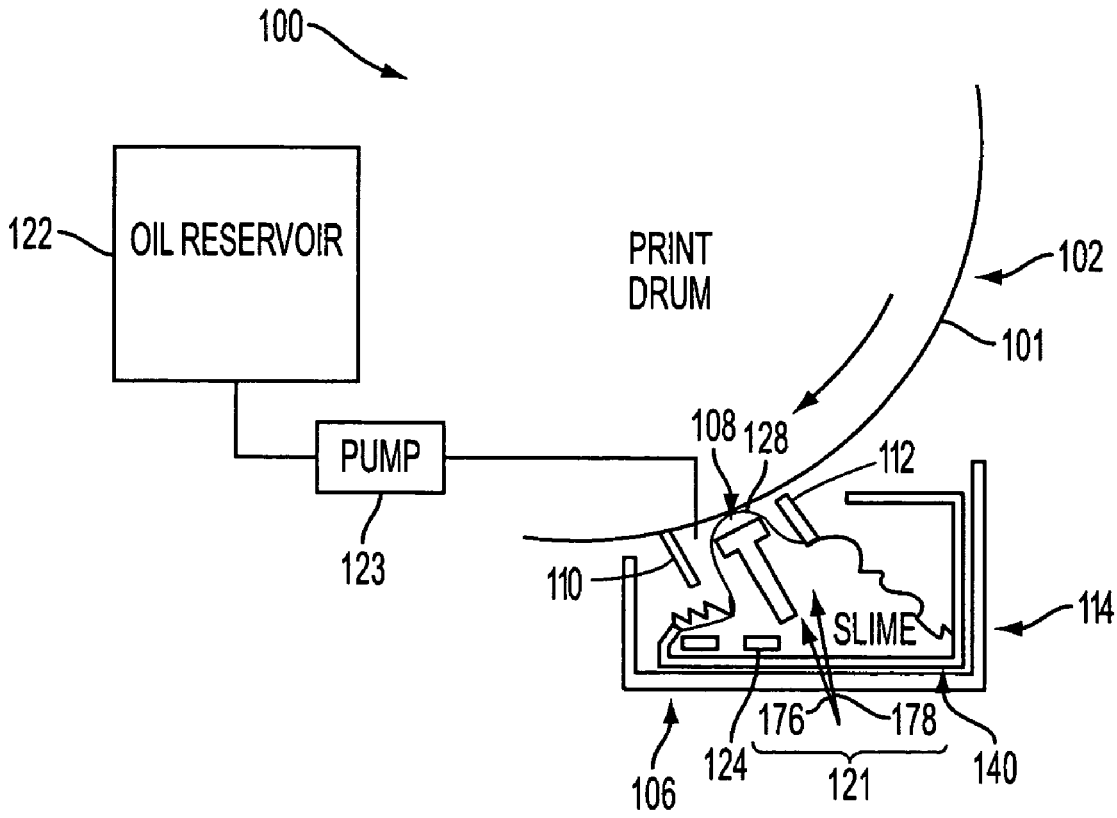
FIG. 5 is a schematic of an ink printer with a blotter type applicator in an exemplary embodiment.
Figure 6:
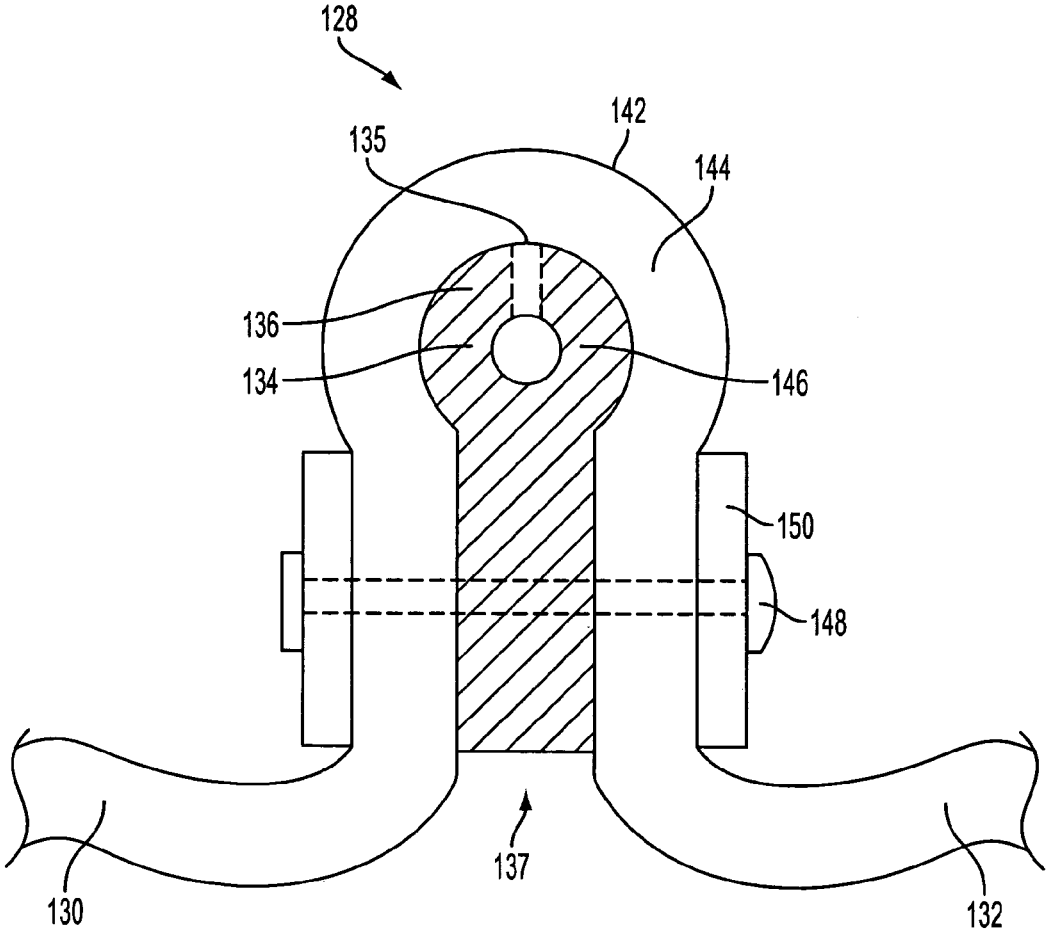
FIG. 6 is a schematic of the blotter type applicator of FIG. 5.

Referring to FIGS. 5 and 6, the applicator 108 may be a blotter 128. The blotter 128 may have an internal support structure 137 that may include an internal release agent delivery tube 134. The delivery tube 134 may extend along a length of the blotter 128. The internal support structure 137 is a support structure made from a strong material such as aluminum or plastic or the like. This support structure may be porous or may have a full-length hole or tube inside it to deliver release agent as close as possible to the imaging member (e.g., drum 102). The delivery tube 134 may be plugged on one end and may have a release agent inlet at another end. One or more smaller holes 135, or slots, or the like may be distributed near the part of the support structure nearest to the imaging member. These holes 135 are used to distribute the release agent evenly along the full length of the blotter 128. The delivery tube 134 may be attached to a pump 123 that pumps release agent to the delivery tube 134.

The blotter 128 may have an outer layer 144 made of a porous, low coefficient of friction, high abrasion resistant material, such as, for example, flat bond polyester, felt, foams, or the like. Other desirable properties of the outer layer include an ability to wick or transport release agent. However, it is envisioned that the blotter 128 may be made or coated with any material that allows the blotter 128 to apply release agent as described herein. The blotter 128 may have a body including an outer layer 144 and an internal support 137. The outer layer 144 may be composed of felt, foam, or any other porous material. The support 137 or 146 may be composed of an aluminum extrusion, a capacitor plate, or the like.

Figure 7:
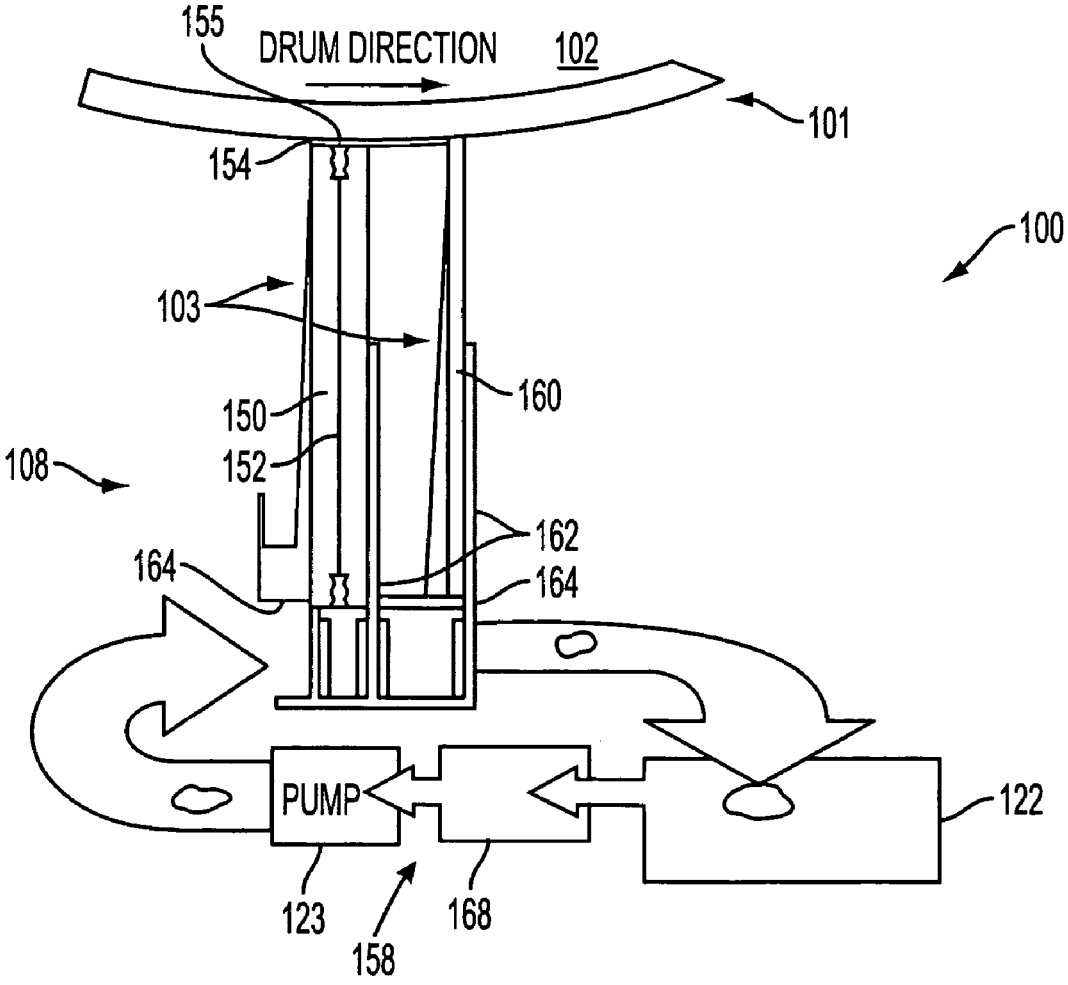
FIG. 7 is a schematic of an ink printer with a blade type applicator in an exemplary embodiment.

Referring to FIG. 7, the applicator 108 may be a blade 150 that has at least one internal passageway 152 along its length. The passageway 152 permits the flow of the release agent to a tip 154 of the applicator blade 150. The applicator blade 150 may work in either contact or non-contact modes. In a non-contact mode, the blade 150 is held very close to the drum 102 while the release agent is pumped up the internal passageway 152. The release agent that emerges from the passageway 152 at the tip 154 of the blade 150 will bridge a gap 155 between the tip 154 of the blade 150 and the drum 102. As the drum 102 spins, release agent may be pumped up to the interface (i.e., the gap 155) faster than it is applied to the surface 101 of the drum 102. Excess release agent 103 may run down the blade 150 and/or a second blade 160 to be reclaimed back into a pump system 158.

In another embodiment, the capillary energy of the two closely positioned blades, blade 150 and blade 160, may act to draw release agent to the surface 101 of the drum 102. The release agent may be metered into a thin film on the drum 102 using metering properties of the "capillary" blades.

In another embodiment, the blade 150 may act as the applicator 108 and the metering blade 110. Alternatively, the blade 150 may act as the applicator 108 and the second blade 160 may act as the metering blade 110.

Although two blades are shown in the embodiment of FIG. 7, it is envisioned that only one or any number of blades may be incorporated into the release agent application and/or drum cleaning process.

One or a plurality of blade supports 162 may support the blade 150 and the second blade 160. The blade supports 162 may be attached to a shelf tray, a container, or any like collection device 164. The collection device 164 may capture the excess release agent 103 as release agent runs down the blade 150 and/or the second blade 160. The recaptured release agent may be transferred from the collection device 164 to a reservoir 122, and the recaptured release agent may be filtered by a filter 168 before being pumped back to the internal passageway 152 of the blade 150.

III. Reservoirs

The exemplary embodiments include a remote reservoir tank for storing and supplying release agent. For example, in the exemplary embodiments of FIGS. 2-5, 7 and 8, the applicator 108 is remote from the reservoir. That is, the applicator 108 does not act as both an applicator and a reservoir for the release agent. Accordingly, because the applicator 108 does not need to store release agent, the applicator 108 will not have to be replaced until it is worn out. Instead, the size of the reservoir and the life of individual components of the DMU will determine when maintenance of the DMU may be needed.

As described above, the applicator also acting as the reservoir, the release agent may be pumped to the applicator from the separate and distinct reservoir, as needed. For example, the embodiment of FIG. 8 shows a reservoir 122. The reservoir 122 stores release agent remotely from the applicator 108. As needed, release agent may be supplied to the applicator 108 via a pump 123. More specifically, in this exemplary embodiment, release agent is pumped from the reservoir to an applicator sled 116, wherein the release agent is absorbed or otherwise collected by the applicator 108 for application to the surface 101 of the drum 102. Alternatively, as shown in FIG. 3, the release agent may be pumped from the reservoir 122 directly to the applicator 108, e.g., the sled 118

In the embodiment of FIG. 5, an adjacent reservoir 124 is located directly under the applicator 108. The blotter 128 may receive release agent from the reservoir 122. More specifically, referring to FIGS. 5 and 6, the outer layer 144 of the blotter 128 may encompass the support structure 146 and the outer layer 144 may have two legs, one on either side of the support structure 146. The two legs of the outer layer 144 may respectively define a reclaim wick 130 from the metering blade 110 and a reclaim wick 132 from the pre-cleaning blade 112. The reclaim wick 130 from the metering blade 110 and the reclaim wick 132 from the pre-cleaning blade 112 may be made of the same material as the blotter 128. The reclaim wick 130 from the metering blade 110 and the reclaim wick 132 from the pre-cleaning blade 112 may provide the blotter 128 with recycled release agent, as described in more detail below, i.e., after filtering.

The release agent, and debris mixed with ink coming off the metering blade 110 may be filtered through a filter 168 (as shown in FIG. 8) and the cleaned release agent may be re-circulated back to the reservoir 122, and then pumped to the applicator 108. Alternatively, the clean release agent may be re-circulated to the adjacent reservoir 124 and then to the applicator 108 through a capillary action of a wick. If the pre-cleaning blade 112 is sufficiently effective, the release agent coming off the metering blade 110 will be clean; therefore, this release agent may be re-circulated directly to the applicator 108. The filter 168 may function for the life of the DMU 106; however, the filter 168 may alternatively be replaced periodically.

Alternatively, similar to the embodiments of FIGS. 3 and 8, and as shown in FIG. 2, the pump 123 may pump fresh release agent from the remote reservoir 122 directly to the applicator 108 for application to the surface 101 of the drum 102.

The remote reservoir 122 and/or the adjacent reservoir 124 together with the pump system 158 may provide a mechanism for providing fresh release agent to the applicator 108. The embodiment of FIG. 7 illustrates an overview of a reservoir 122 and pump system 158, as described herein in more detail below.

Print quality artifacts may result if the release agent applicator is too saturated or too dry. Also, if the system is oversaturated, a person may spill release agent while handling the DMU, for example, when conducting maintenance on the DMU. Thus, the release agent saturation level of the applicator 108 may be maintained within a favorable or optimal operating window by use of the reservoir and pump system described herein with reference to the exemplary embodiments. Print quality may be improved because the applicator, with a saturation level maintained within the favorable or optimal operating window, with respect to the amount of release agent the applicator carries, is neither too saturated nor to dry.

IV. Pump

More specifically, in the embodiment of FIG. 7, the blade 150 that has at least one internal passageway 152 along its length, permits the flow of the release agent to a tip 154 of the applicator blade 150. A pump system 158 has a pump 123 that may pump the release agent into the internal passageway 152. The duty cycle of the pump 123 may be set so the pump rate is equal to the average release agent depletion rate of the applicator.

In the embodiment of FIGS. 3 and 4, release agent is pumped, via a pump 123, directly onto the sled 118 that may engage the drum 102. The release agent may be flooded into a region 121 between the surface 101 of the drum 102 and a top surface 126 of the sled 118.

In the embodiment of FIGS. 5 and 6, the delivery of the release agent is shown just below the area of the application of release agent to the drum 102. The delivery tube 134 may be attached to a pump 123 that pumps release agent to the delivery tube 134.

The reservoir 122 may store fresh release agent and/or excess release agent received from, for example, the metering blade 110. The excess release agent may be filtered prior to storing in the reservoir 122. Alternatively, a filter 168, as shown in FIG. 7, may filter the release agent after it is pumped from the reservoir 122. The pump 123 then pumps the clean release agent directly to the applicator 108.

In an alternate embodiment, the release agent may be pumped to a device that supplies the applicator 108 with the release agent, for example, as described above with respect to the sled 116 of FIG. 8.

It is envisioned that any type of pump or system in which release agent may be transferred from a reservoir or other storage container to the applicator may be used with any of the exemplary embodiments described herein.

V. Drip Bar

Figure 9:
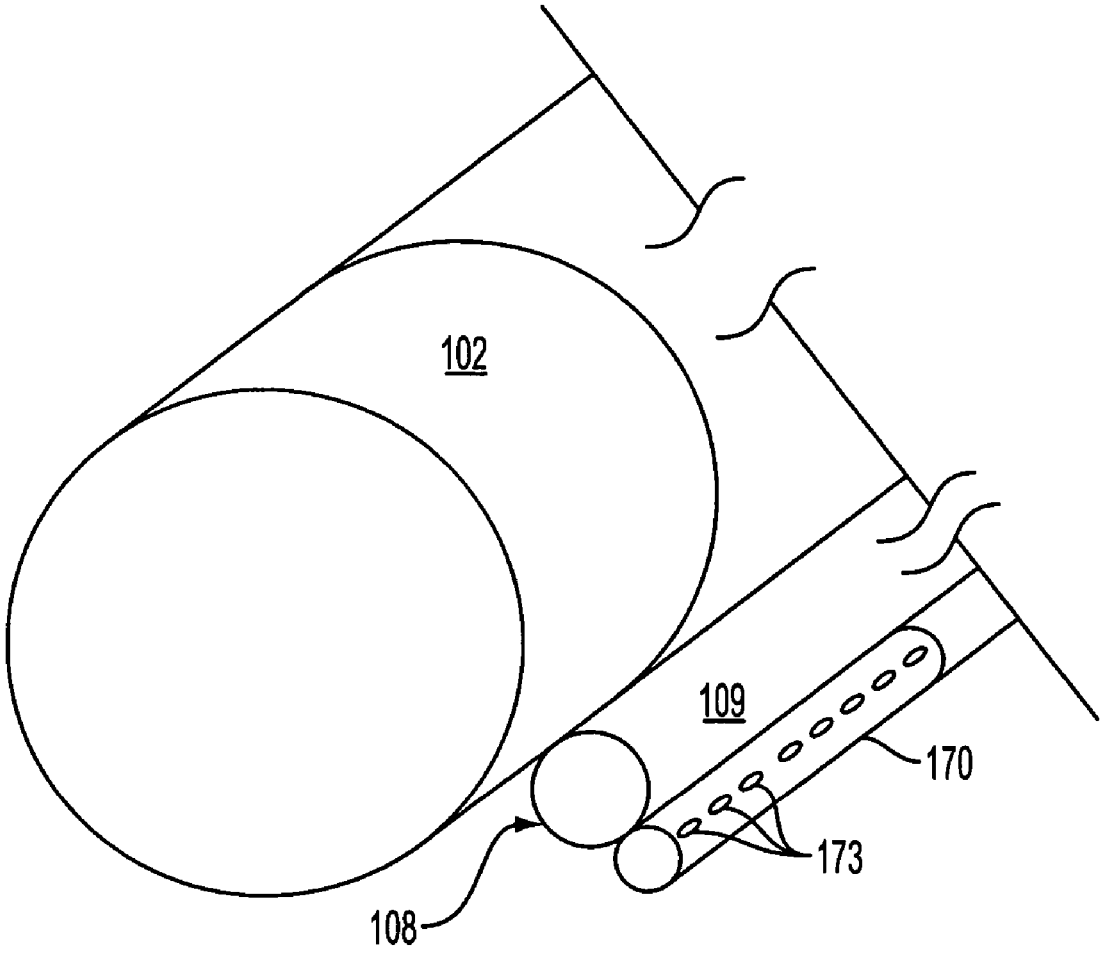
FIG. 9 is a schematic of a drip bar in an exemplary embodiment.

In the embodiment of FIG. 9, the pump 123 may take release agent from the reservoir 122 and may pump the release agent to a drip bar 170. The drip bar may be constructed as a tube that allows for multiple release agent delivery points along the external length of an applicator. This will help sustain a more uniform release agent delivery to the drum along a length of the applicator.

With reference to FIG. 9, the drip bar may be shaped as a tube, one end of which is connected to an output of the pump 123 and the other end of which is sealed. The purpose of the drip bar is to supply release agent to the applicator 108 by dripping release agent onto the applicator 108. The bar could have a series of holes 173 along its length or one single hole to drip the release agent on the applicator 108. Although the drip bar 170 of FIG. 9 is shown with the roller 109, it is envisioned that any number of different applicators may be used with the drip bar 170; for example, the applicator may include a sled, a blotter, or the like.

VI. Saturation Sensors

A sensor or other device may be used in order to determine when or if fresh release agent should be provided to the applicator 108. For example, the release agent saturation level of the applicator 108 may be maintained within a favorable or optimal operating window using a closed-loop saturation level-sensing scheme. As the applicator is depleted of release agent, a sensor may monitor its saturation level. A control system may then determine whether the saturation level has dropped below a threshold, and then correspondingly turn on a pump, for example, to provide additional release agent to the applicator.

Alternative to using a sensor, if the release agent consumption versus the number of pixels printed is known, release agent can be delivered to the applicator using an open-loop pixel counting scheme. There is a relationship between release agent removed from the system by the image/media and the ink coverage. For any given solid ink printer, a blank sheet will carry away less release agent than a solid fill image. This relationship has been found to be variable from printer to printer. Much of this variability is due to drum surface differences. However, within a printer, this relationship is quite constant unless there has been excessive wear or damage to the metering blade. Therefore, the printer could compute an average release agent consumption based on how much release agent it has pumped to the roller relative to the number and mix of images. Then, if the average release agent usage is continually computed and monitored, the printer could determine if the blade has been damaged or is worn. Using closed-loop saturation level sensing, the printer could keep track of the amount of release agent added to the system relative to the number of pixels printed. Therefore, a printer, for example, could construct an internal control chart for release agent consumption. Then, as the system ages, the printer could determine when the system is ready for replacement based on a significant change in release agent consumption.

The exemplary embodiments include a capacitive sensor 104 that measures the volume or mass of the release agent currently being held by the applicator 108. With respect to the embodiments of FIGS. 2 and 8, which include the roller 109 as the applicator 108, a conductive core 171 of the roller 109 is used as one plate 172 of a capacitor. A second plate 174 of the capacitor may be a conductive semi-circle, oriented concentric to a core of the roller 109. The sensor thus includes a capacitor section constructed of at least two electroconductive plates, the one plate 172 and the second plate 174, oppositely arranged. An electric circuit portion (not shown) is adapted to detect a capacitance between the electroconductive plates, which is varied according to the amount of release agent in or on the applicator 108. The capacitance sensor measures the capacitance between the one plate 172 and the second plate 174. The capacitance varies with distance between the plates, area of the plates and the dielectric medium that is between the plates. In the embodiments of FIGS. 2 and 8, the dielectric medium between the plates is the applicator material. The applicator material is porous; therefore, the dry applicator volume will contain a large amount of air. Air has a dielectric constant of about 1. As the applicator material absorbs release agent, the air is displaced. The dielectric constant of the release agent is much greater than 1. Therefore, the capacitance of a dry roller will be much lower than the capacitance of a fully saturated roller.

Referring to the embodiment of FIG. 5, a capacitance sensor is used in conjunction with a blotter type applicator. The capacitor uses two flat plates, an inner capacitor plate 176 and an outer capacitor plate 178, to sandwich the applicator material (i.e., release agent). The inner capacitor plate 176 can be a conductive extrusion that is also used as a support structure of the blotter 128.

Alternatively, the inner layer 146 of the blotter 128 may act as the capacitor plate 176. A fastener 148, electrically isolated from the inner layer 146, may attach the body of the blotter 128 to a grip 150. The grip 150 may act as the outer capacitor plate 178.

The saturation level of the applicator 108 may be sensed using the capacitance sensors described herein or by other means. For example, dry applicator material has a dielectric constant that is a function of the material and void volume. The release agent, consisting of, for example, oil, has a dielectric constant of about 3 or 4 and air has a dielectric constant of about 1. Therefore, as the void volume in the applicator material is filled with, for example, oil, the dielectric constant will increase. Once the applicator material is fully saturated, the dielectric constant will be enhanced or maximized.

The oil delivery rate to the applicator is set so that the pump rate is greater than or equal to the average release agent depletion rate of the applicator 108, which is either measured by a saturation sensor 121 (see FIGS. 5 and 8), or estimated by pixel counting, or by other means.

The exemplary embodiments include a capacitive sensor that measures the volume or mass of the release agent currently being held by the applicator 108. However, it is envisioned that any type of sensor that measures the amount of release agent at the applicator or any other part of the printer may be used.

VII. Metering Blades

The metering blades shown in FIGS. 2, 3, 5, 7 and 8 may be elastomer blades. However, the blades may be constructed with any material or in any way that allows metering of the release agent applied to the drum 102 by the applicator 108. The metering blade 110, for example, may periodically be spring loaded against the drum 102. The amount of blade force on the drum 102, the roughness of the drum, and the durometer and edge condition of the metering blade 110 may affect the rate of dispersion of release agent. The metering blade 110 may also clean any ink off of the drum 102 that has not been transferred to the print medium. The metering blade 110 may capture any residual ink, along with other pixels and debris, on the drum 102. The ink pixels and debris may be funneled (via a funnel 117, such as shown in FIGS. 3 and 8, for example) to a reclaim wick where excess release agent is returned to the reservoir 122, and the excess ink pixels and debris are filtered from the excess release agent and sent to a waste container, as discussed in more detail below.

Referring to FIG. 2, the second plate 174, or outer capacitor plate, may also serve to assist the metering blade 110. That is, the second plate 174 may act as a guide surface to catch release agent running down the metering blade 110 and direct it to the applicator 108.

The filter 168 may be used to filter the mixture of release agent, ink, and debris so that the release agent may flow back to the reservoir and/or to the pump 123 with a minimal amount of ink and debris. The filter 168 may be replaced at the end of its life, when, for example, it is completely clogged with release agent, pixels and/or debris.

The reservoir 122 may store enough release agent to allow for no or minimal maintenance during the life of the DMU. The reservoir may have at least one input port, one for fresh release agent supply from a reservoir consumable, one for topping-off, and the other for returning filtered release agent from the collection device 164 to the reservoir 122. Furthermore, the reservoir 122 may have at least one output port for release agent supply.

VIII. Pre-Cleaning Blade

To keep the applicator 108, such as, for example, the blotter 128, as well as the metering blade 110 and the reclaim wick clean, the pre-cleaning blade 112 may be engaged against the drum 102 at a specific angle and force while the drum 102 rotates, preferably for at least one revolution. More specifically, the pre-cleaning blade 112 may be positioned at a high attack angle to the drum 102 in a wipe mode (i.e., wiping the surface of the drum), or at a shallow attack angle to the drum 102 in a doctor mode (i.e., chiseling the surface of the drum). The pre-cleaning blade 112 may clean the drum 102 prior to the metering blade 110 and/or the applicator 108 coming into contact with the drum 102. The pre-cleaning blade 112 may collect untransferred ink, debris and excess release agent, on the drum 102.

The pre-cleaning blade 112 may be an elastomer positioned to engage against a "dirty" portion of the drum 102 prior to the applicator 108 or metering blade 110. That is, after an image is fixed onto a print media, the portion of the drum 102 upon which the print media was previously in contact with, is engaged by the pre-cleaning blade 112. The drum 102 will rotate against the pre-cleaning blade 112, and the pre-cleaning blade 112 will remove the untransferred ink and other debris remaining on the drum 102. The debris that is collected will run down the pre-cleaning blade 112, aided by gravity, into a collection area.

FIGS. 2, 3, 5, 7 and 8 show the pre-cleaning blade 112 relative to the other components in the system. The pre-cleaning blade 112 will protect the applicator 108, such as, for example, the blotter 128, the metering blade 110 and the reclaim path from contamination, thereby extending the life and efficiency of the applicator 108, metering blade 110 and reclaim path, as well as the entire DMU.

The position of the pre-cleaning blade 112, with respect to the drum 102, may be set based on the metering blade 110 and the timing of the print cycles of the imaging device. More specifically, when the metering blade 110 scrapes the excess release agent off of the drum 102 to create a thin film of release agent on the drum 102, an area in front of the metering blade 110 may be created that is full of the release agent. That is, when the metering blade 110 is removed from the drum 102, an excess line of the release agent (i.e., release agent bar or release agent defect) may remain. Accordingly, there is a need to account for the timing of where the media touches the drum 102 relative to the release agent bar.

As the image is being transfixed off of the drum, the release agent bar from the previous DMU cycle will pass in front of the pre-cleaning blade 112. The pre-cleaning blade 112, the applicator 108 and the metering blade 110 may be arranged so that the pre-cleaning blade 112 is either just ahead or just behind the release agent bar. To reduce or minimize the amount of release agent collected in the pixel and debris waste area, engagement of the pre-cleaning blade 112 may occur after the release agent bar is created. As the drum 102 rotates with these three components engaged against the drum 102, the pre-cleaning blade 112 removes un-transferred pixels and debris, the pre-cleaned drum 102 then has release agent applied thereon by the applicator 108, and finally, the metering blade 110 reduces the release agent on the clean section of the drum 102 to a thin, uniform film.

The drum 102 may continue to rotate with the pre-cleaning blade 112, the applicator 108 and metering blade 110 engaged for a specific distance; then the applicator 108 and pre-cleaning blade 112 may be disengaged from the drum. The metering blade 110 may continue to wipe the drum to collect excess release agent into a release agent bar. The metering blade 110 may disengage so the release agent bar is positioned on the drum 102 for the next print. In an exemplary embodiment the applicator 108 and pre-cleaning blade 112 are periodically engaged while rotating the drum 102 without engaging the metering blade 110. This may cause the pre-cleaning blade 112 to be "washed down" with release agent, helping to move pixels and debris further down into the waste collection area.

Additionally, the applicator 108 may be raised on a partial section of the drum 102 so that the "ink on drum" marks (IOD marks) could be printed on a thick layer of release agent. That is, a specific pattern of ink (i.e., IOD marks) may be applied to the drum 102 with a printhead, and a scanner may then be used to scan the pattern of ink to determine if there are any defects in the printhead, such as, for example, a missing jet. These specific head diagnostic print images (IOD marks) can be removed from the drum using the pre-cleaning blade, applicator or metering blade, rather than the normal method of transferring to a piece of paper. This method of removing head diagnostic images from the drum surface with the drum maintenance system rather than with a piece of paper is advantageous because the diagnosis can be done internally without wasting paper. By raising the applicator 108 on the partial section of the drum 102, easier removal of the IOD marks would be enabled. To remove the IOD marks, the pre-cleaning blade 112 may be engaged without engaging the metering blade 110. This will protect the metering blade 110, applicator and reclaim path from clogging up with ink, pixels or the like.

Furthermore, certain types of media jams, for example, present an increased potential for contamination of the DMU with un-transfixed ink. Therefore, when jams in the imaging device occur, a "post-jam drum clean" cycle may be performed. The post-jam drum clean cycle may raise the pre-cleaning blade 112 and the applicator 108 just after the release agent bar; and the metering blade 110 may not be raised. The drum 102 would rotate for a set number of revolutions, cleaning the remainder of the un-transferred ink off the drum 102 that was left behind after the last ink image transfer cycle. The post-jam drum clean cycle may help to further protect the metering blade 110 and reclaim path from clogging up with pixels and may also eliminate the undesirable necessity of having a cleaning sheet processed in the middle of a print cycle to recover from a jam, as occurs in the related art.

Although the exemplary embodiments are directed to a pre-cleaning blade, such as, for example, a blade composed of a rectangular urethane strip that is attached to a sheet metal support, any device that can clean the drum 102 may be used. For example, a brush that is made of, for example, looped fibers, or a device made with a web-type material, or the like device may be used.

IX. Waste Collection Container

In the embodiments of FIG. 8, for example, a waste collection container 180 may be used in conjunction with the pre-cleaning blade 112. This container 180 can be located to catch and store all of the debris and release agent that are removed from the drum 102 by the pre-cleaning blade 112. This container 180 may be large enough to store the debris and release agent collected over the life of the DMU 106. This container 180 may have a filter and debris storage system 114, as shown in FIG. 8, that returns the excess release agent collected by the pre-cleaning blade 112 to the applicator 108. For example, the embodiment of FIG. 8 illustrates excess release agent captured by the metering blade 110 and debris and release agent removed from the drum 102 by the pre-cleaning blade 112 collected by the container 180. The collected debris and release agent are filtered, for example, by the filter 168, prior to being transferred to the reservoir 122, and eventually the release agent is recycled.

Alternatively, the container 180 may be remote from the reservoir as shown in FIGS. 2, 3 and 5. That is, the container 180 may be separated from the main DMU 106 so that the container 180 may periodically be replaced with an empty container. The waste isolated by the container 180 may be isolated from the rest of the system.

Alternatively, the metering blade 110 and the applicator 108 may be housed in an impermeable container that is intended to keep any free release agent from migrating to other areas of the printer. For example, when the printer is printing at full print speed continuously, the rate of release agent running down the metering blade 110 with each cycle may be greater than the reclaim rate. In this case, free release agent may build up in the system. Further, for example, during a stripper jam, a user may need to remove the DMU 106 to gain access to the jammed media. Therefore, there is a potential for this built up free release agent to spill onto the user, or floor, or housing, or the like. A sensor could be placed in the housing to detect when there is a build up of free release agent. Then, the printer could pause to allow the free release agent to be absorbed back into the applicator or returned to the reservoir, thereby discouraging the build-up of release agent. Alternatively, an alert may be provided to a user to let the user know that the built up free release agent is reaching a specific level, for example, approaching an unacceptable level.

It is envisioned that other parts of the DMU 106 may also be removable and/or interchangeable. For example, the blotter 128 may be held in a replaceable tray 140 (see FIG. 5) that may be replaced periodically while leaving the remaining components of the DMU 106 in place. For example, in an exemplary embodiment, a customer replaceable unit memory may also reside in the replaceable tray, and the blotter 128 may be replaced while leaving the unit memory in place.

X. Actuators

The drum maintenance ("DM") system of the exemplary embodiments has requirements that are new and unique among imaging devices, such as, for example, solid ink printers. Specifically, the size requirement of the release agent bar, which is created by the metering blade and remains on the drum after a DM cycle, combined with print speed requirements, implicitly constrains the engagement and disengagement timing of the drum maintenance system. The result is that the drum maintenance system must be actuated extremely quickly.

Previous drum maintenance systems could operate at much slower speeds than the DM system of the exemplary embodiments. These systems could actuate the metering blade and applicator with the same motion. The DM system of the exemplary embodiments would not be able to meet the new requirements if the metering blade and the applicator were actuated simultaneously due to the inertia of the combined system. The DM system, however, has the following characteristics that meet the new timing requirements: the inertia of the applicator is significantly greater than the inertia of the metering blade; and the metering blade is what creates the release agent bar.

Decoupling the metering blade and the applicator allows separate, non-overlapping actuation times in which the metering blade (which is low-inertia and is the release agent bar-creating mechanism) can be actuated quickly while the applicator (which is high-inertia and does not affect the release agent bar) is actuated at a reasonably slower pace. The metering blade may be engaged first without moving the applicator. Then, the applicator may be engaged without moving the metering blade. Disengagement may be in the opposite order.

If the disengaged cycle happens at about the same time for each of the metering blade and applicator, then the cleaning blade will disengage too late for the release agent to land in the release agent bar, or to be picked up by the metering blade. Thus, the disengage velocity profile may be varied to disengage the cleaning blade and the applicator, and then to separately disengage the metering blade.

Figure 10:
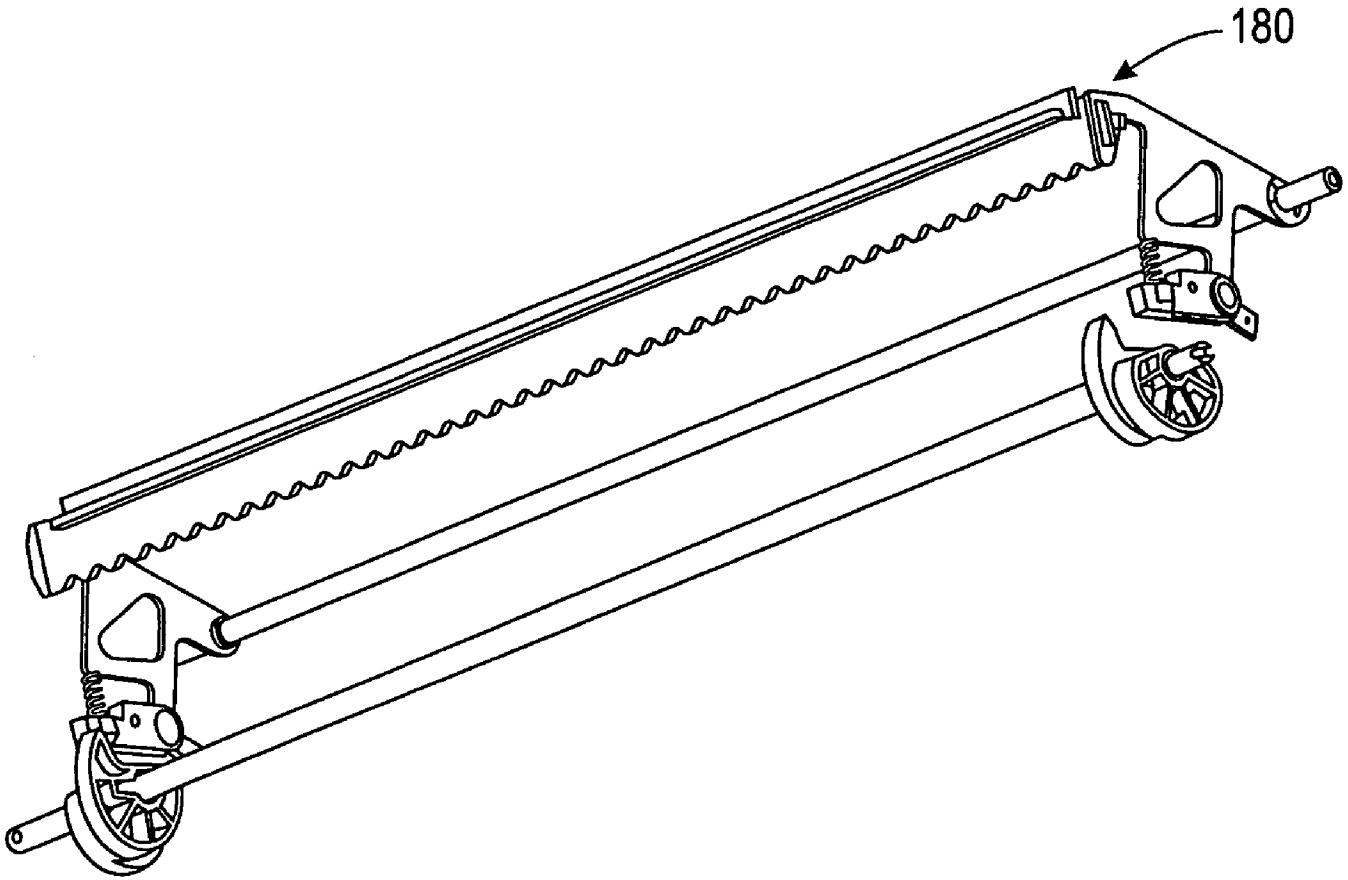
FIG. 10 is a schematic of a metering blade system implementation in an exemplary embodiment.
Figure 11:
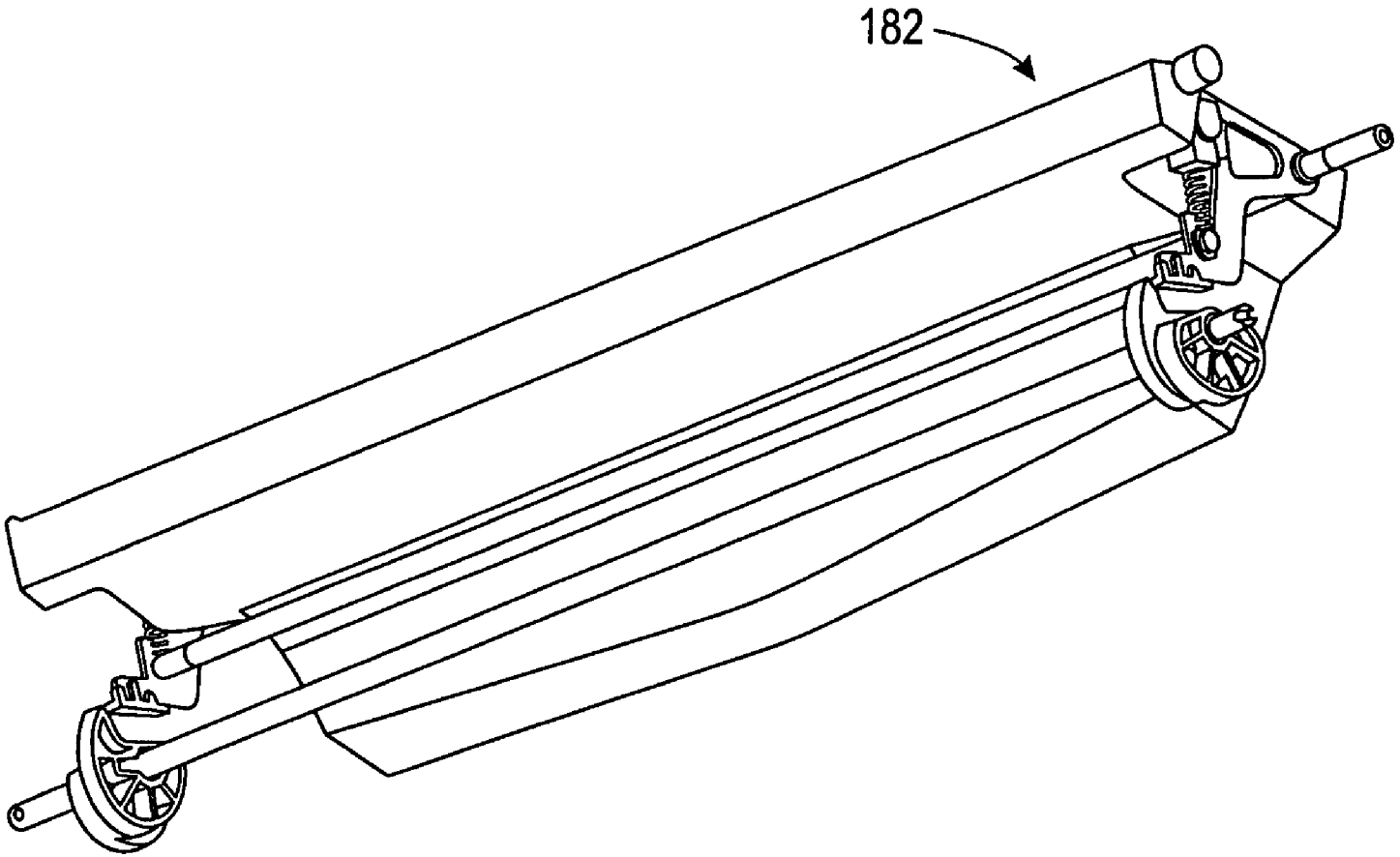
FIG. 11 is a schematic of an applicator system implementation in an exemplary embodiment.
Figure 12:
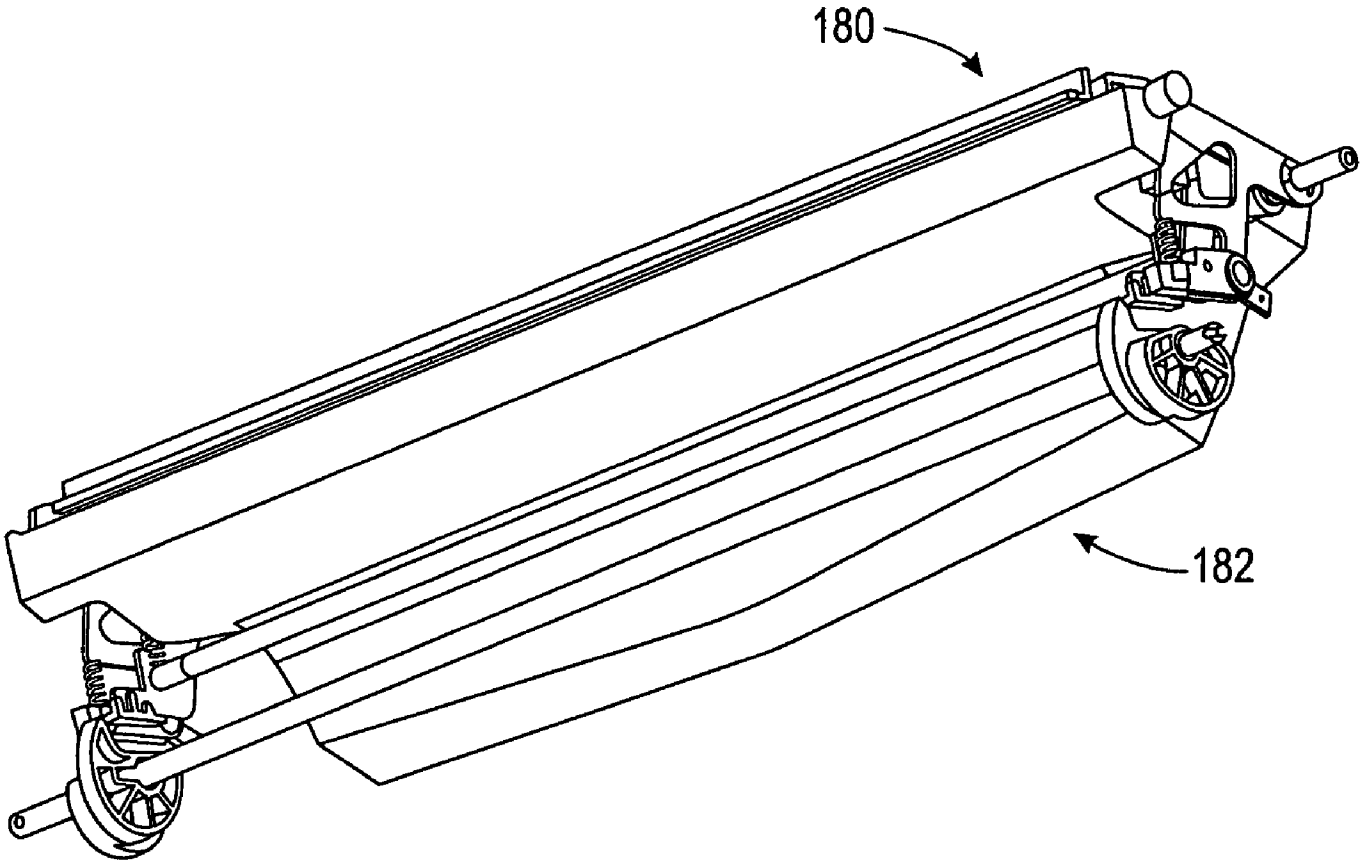
FIG. 12 is a schematic of the implementation of a metering blade system and an applicator system in an exemplary embodiment.
Figure 13:
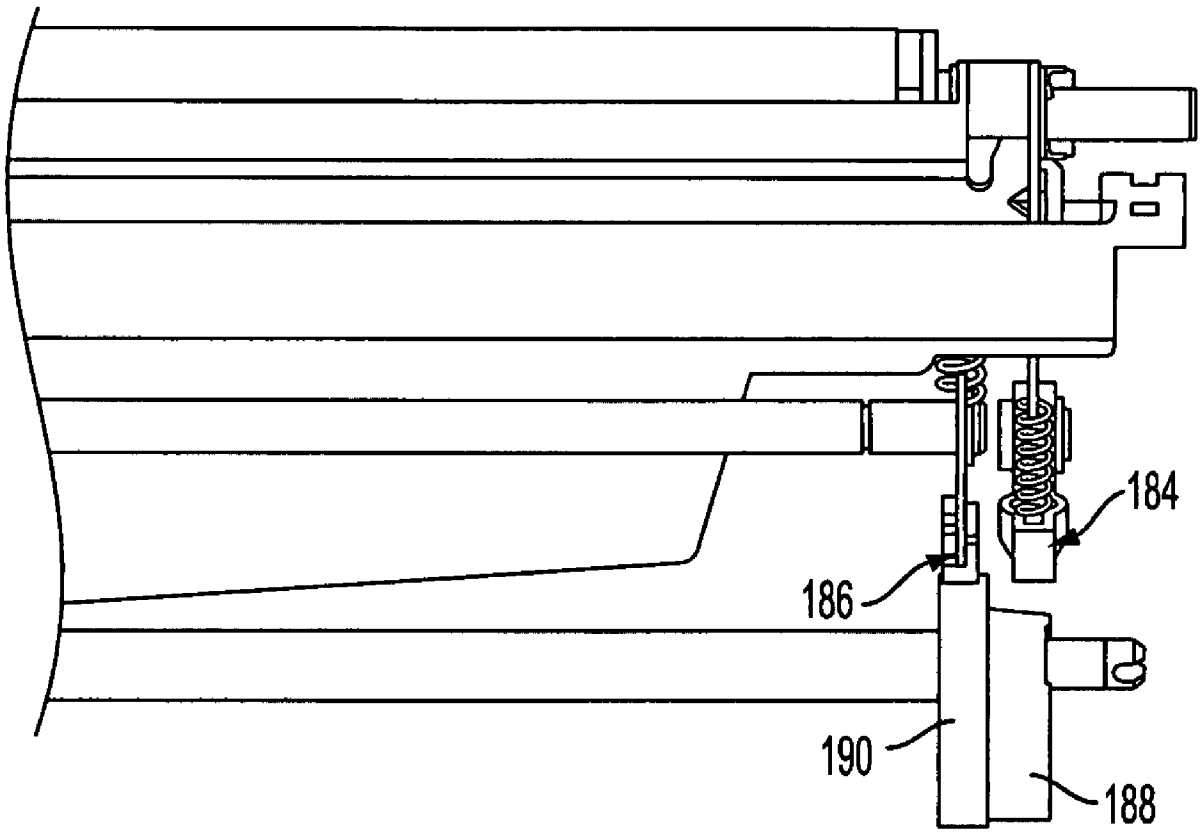
FIG. 13 is a schematic of implementation of independent actuation of cams in an exemplary embodiment.

In the embodiments of FIGS. 12 and 13, a metering blade system 180 is nested around an applicator system 182. FIG. 10 shows the metering blade system 180 and FIG. 11 shows the applicator system 182. FIG. 12 shows the metering blade system 180 and the applicator system 182 nested together.

Figure 14:
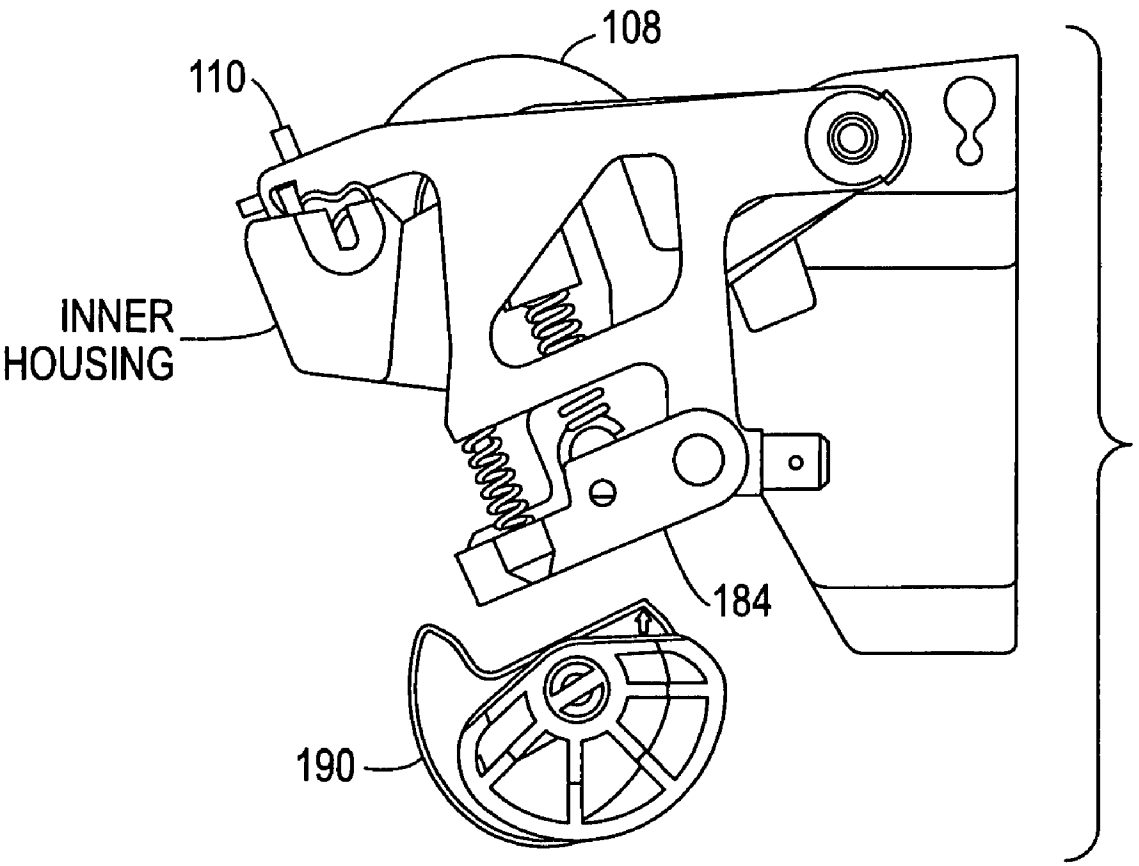
FIG. 14 is a schematic of cams and cam followers in an exemplary embodiment.

Each system has its own set of cam followers, one follower on each end of the system. Metering blade followers 184 are located just outside of applicator followers 186, as shown in FIG. 13. Each end of the system of FIG. 13 is a mirror image of each other. A metering blade cam surface 188 and an applicator cam surface 190 are also shown. Independent actuation is achieved by driving the cam followers with independent cam surfaces. FIG. 14 shows the different cam profiles with respect to the followers.

Accordingly, with reference to the embodiments of FIGS. 2, 3, 5, 7 and 8, the applicator 108 and metering blade 110 are driven into engagement with the drum 102 via a motor and a camshaft. The camshaft supports at least two sets of cams for independently actuating the release agent applicator and metering blade assembly. Alternatively, two independent cams that rotate independently of each other, respectively supported by two independent camshafts, may be used. Further, instead of dual cams, solenoids, rotary actuators, or any device that allows for independent actuation of the applicator 108, the metering blade 110, and/or the pre-cleaning blade 112 may be used in connection with the exemplary embodiments.

As discussed above, the print speed of an imaging device is dependent on how fast all steps of the printing process may be performed. In an exemplary embodiment, the drum 102 is spun at a high rate of speed; this requires that the applicator 108, metering blade 110, and the pre-cleaning blade 112 be quickly and accurately engaged and disengaged with the drum 102, as needed. By providing independent actuation of the applicator 108, the metering blade 110, and the pre-cleaning blade 112, additional flexibility in the process of applying these parts is made available. For example, it may be beneficial for the metering blade 110 to engage the drum 102 after engagement by the applicator 108 so that the metering blade 110 collects excess release agent into the release agent bar, as described above. However, the motor must be able to move fast enough to disengage the metering blade in sufficiently short enough time so as to minimize the size of the release agent bar (i.e., release agent artifact). In addition, the timing between the actuation of the applicator 108 and the metering blade 110 are such that the applicator 108 touches the drum 102 after the metering blade 110 has been engaged, and leaves the drum 102 before the metering blade 110 has been disengaged.

In another exemplary embodiment, variable engagement of the applicator 108 may be desired. For example, the amount of release agent supplied to the surface 101 of the drum 102 by the applicator 108 may depend, in part, on the degree of pressure applied by the applicator 108 against the drum 102, or the degree of contact area of the applicator 108 with the drum 102. The harder the applicator 108 is pressed against the drum 102, the larger the amount of release agent that is applied to the drum 102. The larger the contact area of the applicator 108, the larger the amount of release agent that is applied to the drum 102. Accordingly, the degree of pressure of the applicator 108 against the drum 102, and/or the degree of contact area of the applicator 108 against the drum 102, may vary. The varying degrees of pressure and/or degree of contact area on the drum 102 by the applicator 108 may be accomplished by the variable engagement of the applicator 108. That is, the position of, for example, the cam supporting the applicator 108 may change based on the amount of release agent carried by the applicator 108. Furthermore, as described above, the degree of pressure of the applicator 108, or the contact area of the applicator 108 to the drum 102, based on the engagement of the applicator 108 may be independent of the engagement of the metering blade 110 and/or pre-cleaning blade 112.

For example, the applicator 108 may be attached to, for example, a cam. The amount of engagement of the applicator 108 into the surface 101 of the drum 102 may vary by the rotational position of the cam. Thus, the amount of release agent applied to the drum may be varied with the cam position. Less engagement equals a smaller applicator contact area and less release agent is applied. More engagement provides a larger applicator contact area and more release agent may be applied. In a system where all of the release agent is stored in the applicator, variable applicator engagement could help to increase the life of the system by allowing more release agent to be extracted from the roller, for example, as its saturation level decreases.

In an exemplary embodiment, the pre-cleaning blade 112 may be attached to an actuator 115 (as shown in FIG. 2) that engages both the pre-cleaning blade 112 and the applicator 108. Accordingly, the pre-cleaning blade 112 and the applicator 108 may move against the drum 102 in unison. Alternatively, the pre-cleaning blade 112 may be attached to an independent actuation system.

As discussed above, related art ink printers have a single set of cams to engage both the metering blade and the applicator. Thus, the system of the related art has less flexibility for independent control of the actuation of the metering blade and applicator. The related art systems are designed such that the metering blade touches the drum first during engagement. The metering blade is engaged anytime the applicator is engaged; and, the metering blade leaves the drum after the applicator is disengaged.

An additional cam would allow the applicator and the pre-cleaning blade to be raised without engaging the metering blade. Furthermore, independent suspension for both the applicator and the pre-cleaning blade may be provided. This would allow, for example, the pre-cleaning blade to be engaged against the drum without the applicator being engaged. This additional process flexibility will allow valuable process variations that would otherwise not be possible. Additionally, separating the actuations of the metering blade and the applicator enable the blade engagement/disengagement to meet strict timing requirements.

Furthermore, it is envisioned that the actuators of the exemplary embodiments may be used in a number of different systems. For example, a system including a scanner adjacent to the drum may scan a print pattern that is on the drum. Accordingly, the DMU must act to clean the system so that non-transferred ink, debris, IOD marks and the like that are on the drum are removed prior to the next print cycle. By having independent actuation of the applicator 108 and the metering blade 110, the applicator 108 may be engaged to create an area on the drum 102 coated with release agent that is not metered into a thin film. Accordingly, the IOD marks may be printed on, for example, a thick oil layer and are therefore easier to remove with the pre-cleaning blade.

It is envisioned that any number of advantages may be achieved by the independent actuation of the applicator 108, metering blade 110 and/or pre-cleaning blade 112 including allowing flexibility for high speed printing, cleaning of IOD marks, increase of an ink to release agent ratio for easier removal of pixels and debris from the drum 102, and other advantages described herein and/or later achieved.

XI. Process of Using The Drum Maintenance System

Figure 15:
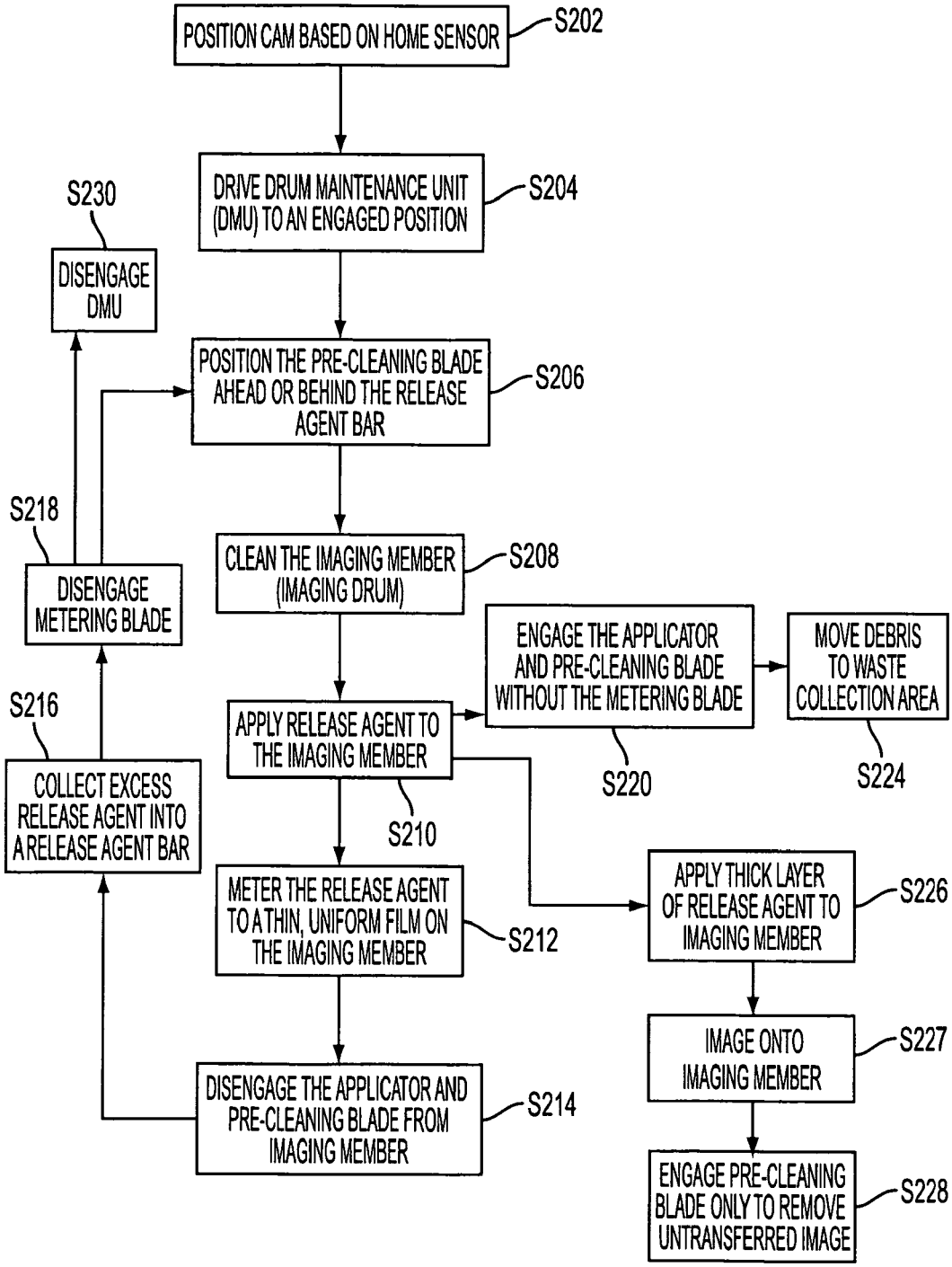
FIG. 15 is a flowchart illustrating a method of cleaning and preparing the imaging member.

Referring to FIG. 15, a method of transferring an image to a substrate is illustrated. During a normal run mode, a drive motor positions a cam by way of a home sensor, as shown at step S202. The cam supports the applicator 108, the metering blade 110 and the pre-cleaning blade 112. The cam is positioned to provide about 2-3 mm clearance between each of the applicator 108 and the surface 101 of the drum 102, between the metering blade 110 and the surface 101 of the drum 102, and between the pre-cleaning blade 112 and the surface 101 of the drum 102. After the cam is homed in step S202, the DMU 106 is ready to be driven to an engaged position, as shown at step S204.

Figure 16A:
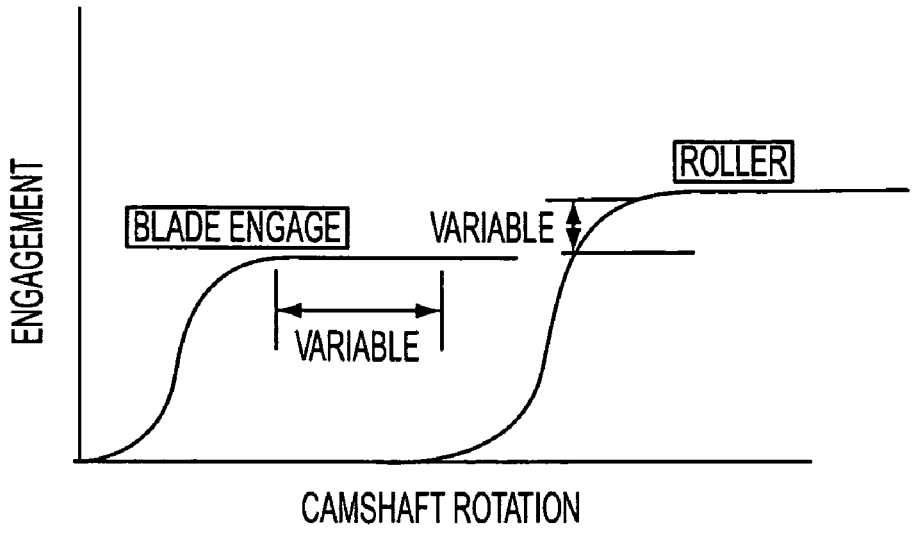
FIGS. 16A and 16B are graphs illustrating an engagement motor profile of an actuator in an exemplary embodiment.
Figure 16B:
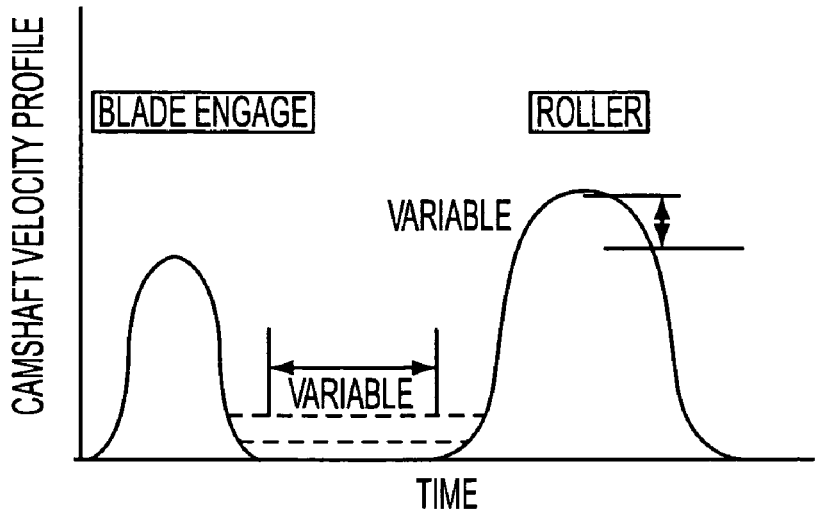

There are at least three variables that can change the amount of release agent delivered by the applicator 108 to the drum 102. These three variables include: the penetration of the applicator 108 into the surface 101 of the drum 102, and the applicator physical properties (compliance and capillary properties). For example, the roller may be disengaged from the drum prior to a full drum revolution. Then the metering blade will spread the release agent already collected over the rest of the drum surface. An engagement motor motion profile is illustrated in FIGS. 16A and 16B. The engagement motor motion profile is initiated by a position of the drum 102. When the drum 102 (and an expected location of a lead edge of the image to be transferred) rotates to a required position, the engagement profile shown in FIGS. 16A and 16B is commanded.

The variable time and penetration is adjusted based on the amount of release agent that needs to be supplied by the applicator 108. To increase the release agent delivery, the penetration of the applicator 108 into the surface 101 of the drum 102 may be increased, and the time from the metering blade engagement and the applicator contact will be shortened.

Referring again to FIG. 15, after the DMU 106 is driven into an engaged position, as shown at step S204, the pre-cleaning blade 112, the applicator 108 and the metering blade 110 may be arranged so that the pre-cleaning blade 112 is either just ahead of or just behind the release agent bar, i.e., the release agent bar from the previous DMU cycle, as shown at step S206. As the drum 102 rotates, the pre-cleaning blade 112 removes un-transferred pixels and debris, as shown at step S208. The applicator 108 then applies release agent to the surface 101 of the drum 102, as shown at step S210. Finally, the metering blade 110 reduces the release agent on the clean section of the drum 102 to a thin, uniform film, as shown at step S212.

The drum 102 may continue to rotate with the pre-cleaning blade 112, the applicator 108 and the metering blade 110 engaged for a specific distance; then the applicator 108 and the pre-cleaning blade 112 may be disengaged from the drum, as shown at step S214. The metering blade 110 may continue to wipe the drum to collect excess release agent into a release agent bar, as shown at step S216. The metering blade 110 may disengage so the release agent bar is positioned on the drum 102 for the next print, as shown at step S218.

In an exemplary embodiment the applicator 108 and pre-cleaning blade 112 are periodically engaged while rotating the drum 102 without engaging the metering blade 110, as shown at step S220. This may cause the pre-cleaning blade 112 to be flooded with release agent, helping to move pixels and debris on the pre-cleaning blade 112 further down into the waste collection area, as shown at step S224.

Additionally, in another exemplary embodiment, the applicator 108 may be raised on a partial section of the drum 102 so that the IOD marks can be printed on a thicker layer of release agent, as shown at step S226. This may assist to make the IOD marks, for example, easier to remove. After an image is transferred onto the imaging member, as shown at step S227, the pre-cleaning blade 112 may be engaged without engaging the metering blade 110, as shown at step S228, to remove the untransferred image. This may protect the metering blade 110 and reclaim path from clogging with pixels.

The motor motion profile may disengage the DMU 106, as shown at step S230. The disengagement of the DMU may be initiated by the drum position. Referring again to FIGS. 16A and 16B, the motor motion profile for disengagement is the inverse of the motor motion profile of engagement, and must accommodate the total engagement motion, which is a function of the DMU applicator age.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A method for maintaining an imaging member of an imaging device, the imaging member being usable to transfer an image onto a substrate, the method comprising:

applying release agent to the imaging member with an applicator;

using a sensing method to determine a release agent saturation level of the applicator;

metering the release agent into a film on the imaging member;

applying the image onto the imaging member;

transferring the image onto the substrate;

storing the release agent remotely from the applicator in a reservoir;

transferring the stored release agent from the reservoir to the applicator;

monitoring the saturation level of the applicator using a closed-loop saturation level-sensing system;

monitoring the amount of release agent pumped to the applicator versus the amount of pixels imaged using the closed-loop saturation level-sensing system; and determining when the metering device is damaged or worn-out by comparison of the monitored amount of release agent pumped and the amount of pixels imaged.

2. The method of claim 1, further comprising:

pumping the stored release agent from the reservoir to the applicator with a pump.

3. The method of claim 1, further comprising:

removing debris from the imaging member prior to applying an image onto the imaging member and after transferring the image onto the substrate.

4. The method of claim 1, further comprising:

maintaining the release agent saturation level of the applicator within a predetermined range by pumping release agent to the applicator when the saturation level of the applicator reaches a threshold value.

5. A maintenance system for maintaining an imaging member of an imaging device, the imaging member being usable to transfer an image onto a substrate, the maintenance system comprising:

an applicator to apply release agent to the imaging member with an applicator;

a sensor associated with the applicator to determine a release agent saturation level of the applicator;

a metering device to meter the release agent into a film on the imaging member;

an ink delivery device to apply the image onto the imaging member;

a transferring device to transfer the image onto the substrate;

a reservoir remotely located from the applicator to store the release agent;

a transfer device to transfer the stored release agent from the reservoir to the applicator;

a controller to monitor the saturation level of the applicator;

wherein the controller maintains the saturation level of the applicator within a predetermined range;

wherein the controller monitors the saturation level of the applicator using a closed-loop saturation level-sensing system; and wherein the controller monitors the amount of release agent transferred to the applicator versus the amount of pixels imaged using the closed-loop saturation level-sensing system and determines when the metering device is damaged or worn-out by comparison of the monitored amount of the release agent pumped and the amount of pixels imaged.

6. The maintenance system of claim 5, wherein the metering device removes untransfered ink, excess release agent and debris from the imaging member prior to the image being applied onto the imaging member.

7. The maintenance system of claim 6, wherein the sensor is a capacitor that measures the dielectric constant of the applicator as a function of release agent saturation level.

8. The maintenance system of claim 5, wherein the transfer device transfers the release agent to the applicator when the saturation level of the applicator reaches a threshold value.

9. The maintenance system of claim 5, further comprising:

a removable housing to house the metering device and the applicator.

10. The maintenance system of claim 9, further comprising:

the removable housing further comprises a sensor to detect at least one of excess release agent, ink and debris collected in the housing.

11. A system for maintaining an imaging member of an imaging device, the imaging member being usable to transfer an image onto a substrate, the system comprising:

means for applying release agent to the imaging member;

means for sensing a release agent saturation level of the means for applying release agent before, during or after every use of the means for applying release agent;

means for metering the release agent into a film on the imaging member;

means for applying the image onto the imaging member;

means for transferring the image onto the substrate;

means for storing the release agent remotely from the means for applying release agent;

means for transferring the stored release agent from the means for storing to the means for applying release agent;

first means for monitoring the saturation level of the means for applying using a closed-loop saturation level-sensing system;

second means for monitoring the amount of release agent pumped to the means for applying versus an amount of pixels imaged using the closed-loop saturation level-sensing system; and means for determining when the means for metering is damaged or worn by comparison of the monitored amount of release agent pumped and the amount of pixels imaged.

* * * * *